US005100003A

United States Patent [19]

Jud

[11] Patent Number: 5,100,003

[45] Date of Patent: Mar. 31, 1992

[54] PACKAGE FOR PACKING PIECES OF GOODS AND PROCESS OF MANUFACTURE THEREOF

[75] Inventor: Wilfried Jud, Obergrafendorf, Austria

[73] Assignee: Teich, Austria

[21] Appl. No.: 467,777

[22] Filed: Jan. 19, 1990

Related U.S. Application Data

[62] Division of Ser. No. 180,101, filed as PCT/AT87/00041, Jul. 22, 1987, Pat. No. 4,917,247.

[30] Foreign Application Priority Data

Jul. 22, 1986 [AT] Austria ..... 1974/86

[51] Int. Cl.[5] ..... B65D 27/34

[52] U.S. Cl. ..... 229/87.05

[58] Field of Search ..... 206/439, 604, 605, 607, 206/610, 632, 634; 383/120

[56] References Cited

U.S. PATENT DOCUMENTS

| | | | |
|---|---|---|---|
| 1,680,946 | 8/1928 | Kalina | 206/610 |
| 2,334,413 | 11/1943 | Kerr | 206/610 |
| 3,306,492 | 2/1967 | Kugler | 206/604 |
| 3,674,195 | 7/1972 | Stone | 206/632 |
| 3,761,013 | 9/1973 | Schuster | 383/120 |
| 3,967,719 | 7/1976 | Tanner, II | 206/632 |
| 4,279,344 | 7/1981 | Holoway, Jr. | 206/632 |
| 4,576,285 | 3/1986 | Goglio | 206/632 |
| 4,781,297 | 11/1988 | Abrahamsson et al. | 206/439 |
| 4,917,247 | 4/1990 | Jud | 206/610 |

*Primary Examiner*—David T. Fidei
*Attorney, Agent, or Firm*—Bierman and Muserlian

[57] ABSTRACT

Package for packing pieces of goods, especially subdivided or subdividable packing goods having an at least approximately even surface area, with a wrapper made of foldable packing material and having at least two strip-shaped doubling areas, each being formed by two strip-shaped areas of the packing material connected with each other at the surface of the packing material generally facing the packing goods, to form a strip-shaped sealing zone, so that each doubling area shows an outer edge, whereby the wrapper is opened by severing the sealing of the sealing zone of at least one of the doubling areas, characterized in that the wrapper includes two of said spaced strip-shaped doubling areas (23', 24') at said at least approximately even surface area, that each of the outer edges of each of these doubling areas (23', 24') are formed by the outer edges of the two strip-shaped areas of the packing material forming the doubling area, and that a tearing up zone (26) is laterally defined by two of said outer edges of the packing material at the outer edges of said two doubling areas.

6 Claims, 2 Drawing Sheets

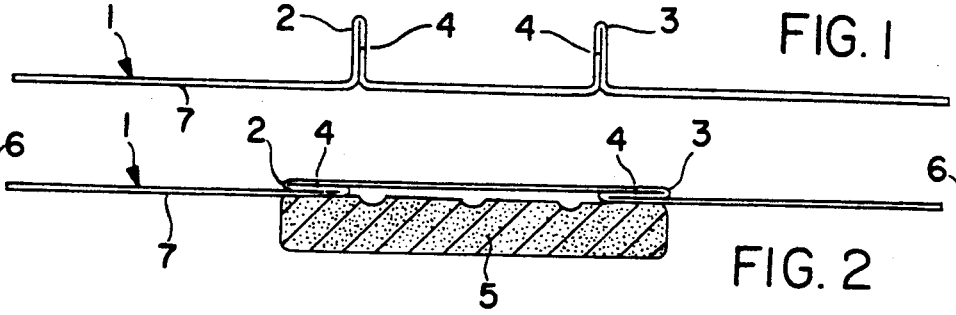
FIG. 1
FIG. 2
FIG. 3
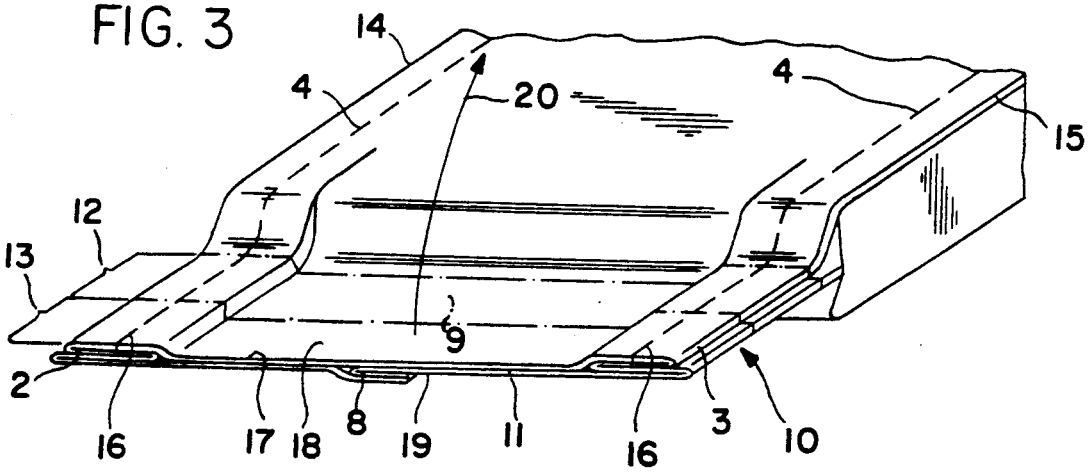
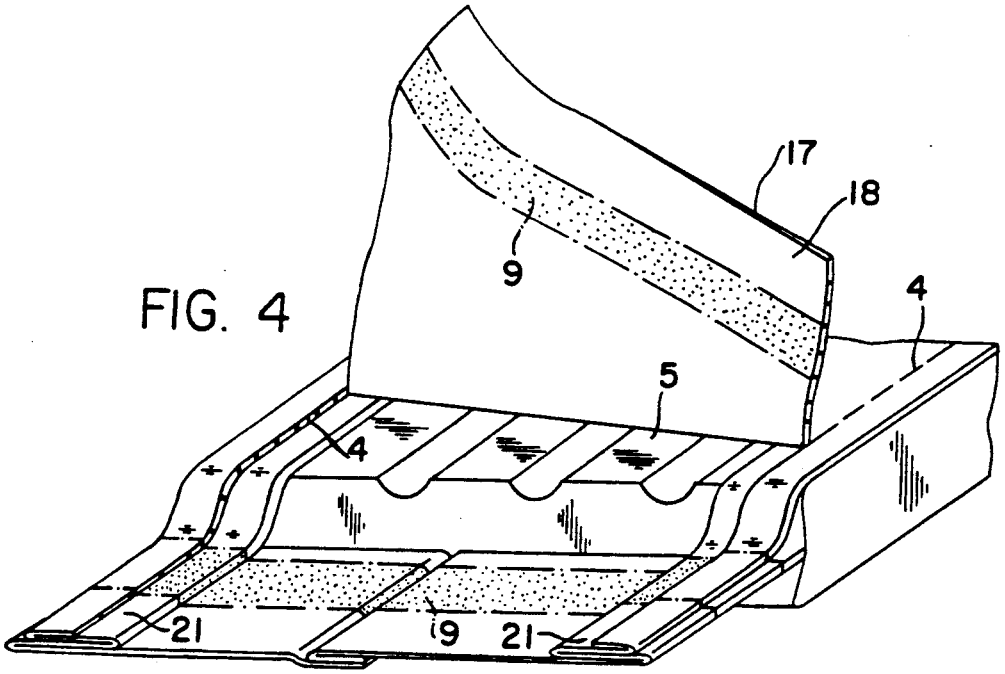
FIG. 4

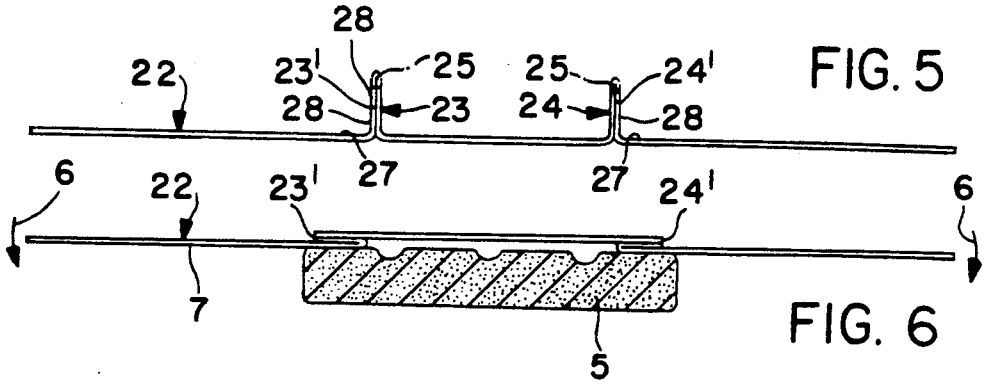
FIG. 5
FIG. 6
FIG. 7
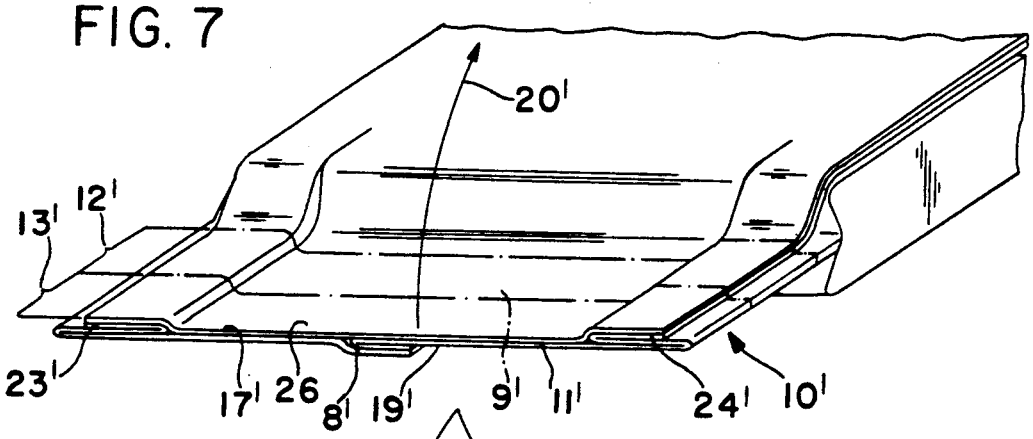
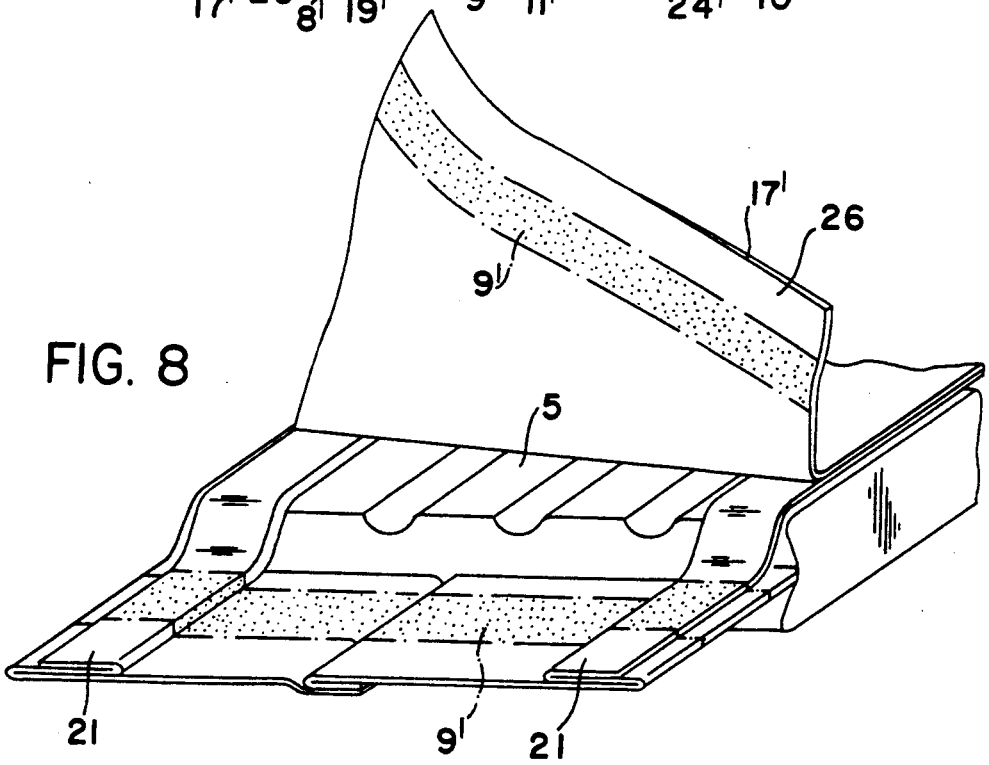
FIG. 8

PACKAGE FOR PACKING PIECES OF GOODS AND PROCESS OF MANUFACTURE THEREOF

PRIOR APPLICATION

This application is a division of U.S. patent application Ser. No. 180,101, filed as PCT/AT87/00041, Jul. 22, 1987, now U.S. Pat. No. 4,917,247.

TECHNICAL FIELD

The invention refers to an essentially gastight package for packing pieces of goods, especially subdivided or subdividable packing goods with a wrapper made of a flat, foldable packing material and having at least two strip-shaped doubling areas of the packing material in which the two layers of the packing material which define each doubling area are connected with each other at the insides of their packing material via a strip-shaped sealing zone whereby the wrapper is opened by severing it at at least one of these doubling areas. The packages according to the invention should, however, not exclusively be designed as tubular bags. Further, the invention refers to an advantageous method of making the package according to the invention.

STATE OF THE ART

A package of this kind is described in the European patent application No. 85104700.1 (publication no. 062291) with reference to FIG. 3. This package which is a tubular bag for packing chocolate has a fold extending from the wrapper in the area of a parting notch of the chocolate bar and being provided within the strip-shaped area in which both flanks of the fold are sealed together with several separated linear perforation along a break line. The package is opened by holding the latter with the hands at both sides of the fold and by snapping off the package about an axis parallel to the longitudinal extension of the fold with simultaneous breaking of the chocolate bar thereby peeling off the sealed connection of the flanks of the fold until the perforations are exposed whereupon the material bridges between the perforations are torn to obtain a slotted opening through which parts of the chocolate bar can be withdrawn. Such a snapping off during the opening results in a wrapper which is more or less crumpled especially in the area of the created opening. This is undesired especially when the package is only partly emptied and should be stored for some time. Moreover, this package can be used only for relatively hard packing goods.

SUMMARY OF THE INVENTION

The invention is based on the object to provide a package of the above-stated kind which can easily be opened in such a manner that the original shape of the package is not essentially altered during opening and withdrawal of packing goods and which can also be used for relatively soft packing goods.

This object is attained by a package in accordance with the invention which is characterized in that in a package with at least even surface area the wrapper includes at this surface area two spaced strip-shaped doubling areas in which in a manner known per se respective two layers of packing material defining the doubling area are connected to each other at their inner sides via a strip-shaped sealing zone and in accordance with the invention laterally enclose a tearing up zone of the wrapper. Advantageously, both folds are arranged in the vicinity of two opposing edges of the even surface area of the package.

According to an advantageous feature of the package in accordance with the invention, the package is characterized in that the tearing up zone is laterally defined by outer edges of the doubling areas enclosing the tearing up zone.

According to another advantageous feature of the invention, the package in accordance with the invention is characterized in that the tearing up zone is laterally defined by predetermined break lines of the packing material which are respectively arranged in the exposed lagers of the doubling areas within the strip-shaped sealing zones wherein the doubling areas enclose the tearing up zone.

According to a further advantageous feature of the package in accordance with the invention, the package is characterized in that the doubling areas are respectively folded over in the direction away from the center of the tearing up zone and toward the surface of the package. Advantageously, the layers of packing material of the folded down doubling areas lying on the surface of the package are connected at least over a part of their surface with the surface of the package through gluing or sealing.

According to a further advantageous feature of the invention, the package according to the invention is a tubular bag with a longitudinal sealing seam and two transverse sealing seams defining the fins of the package whereby both the doubling areas laterally enclosing the tearing up zone extend parallel to the longitudinal sealing seam and cross the sealing zone of at least one of the transverse sealing seams, and whereby the tearing up zone is bounded by the free edge of at least one of the fins. Advantageously, the sealing zone of the transverse sealing seam does not approach at east in the area between the ends of both doubling areas the free fin edge of one fin of the package bounding with its free edge the tearing up zone.

According to a last advantageous feature of the package in accordance with the invention, the package is characterized in that the doubling areas in which predetermined break lines in the packing material define lateral boundaries of the tearing up zone are constituted by folds of packing material at the surface of the package.

Further, the invention is concerned with two advantageous methods of making the package according to the invention.

A first such method is characterized in that two spaced folds are provided in the packing material with their flanks sealed together in a strip-shaped sealing zone, that a strip-shaped area of the fold extending in longitudinal extension of the fold is severed at the respective edges of the folds so that the remaining material of the folds forms doubling areas of packing material with layers of packing material having outer edges which laterally enclose a tearing up zone of the packing material in the package to be made, that both doubling areas are then folded over onto the surface of the package and that afterwards the wrapper is made from the thus prepared packing material.

A second method in accordance with the invention is characterized in that the packing material includes two spaced predetermined break lines, that a fold is respectively provided in the packing material at these predetermined break lines whereby their flanks are sealed together along a strip-shaped sealing zone so that the predetermined break lines extend respectively at one of the flanks of the folds within the sealing zone, that both folds are folded over onto the wrapper and that thereafter the wrapper is made from the thus prepared packing material.

Brief Description of the drawings in connection with two advantageous methods for carrying out the invention.

The invention is subsequently described with reference to the drawing. In the figures, the width of the packing material is exaggerated as far as the cross sectional views are concerned to allow a better understanding.

FIGS. 1 and 2 are a cross section of an embodiment of the invention illustrating the folding of the layers.

FIG. 3 is a perspective, enlarged view of the bag package of FIGS. 1 and 2 and FIG. 4 is a perspective view of FIG. 3 in a semi-opened state.

FIGS. 5 and 6 are a cross section of another embodiment of the invention illustrating the folding of the layers.

FIGS. 7 and 8 are perspective views of the bag package of FIGS. 5 and 6 similar to FIGS. 3 and 4.

FIGS. 1 and 2 respectively illustrate in cross sectional views the making of a preferred embodiment of a package according to the invention in the form of a tubular bag prior to the making of the bag.

A web 1 of packing material which is unilaterally provided with a sealing layer applied in profile and with two breaking areas extending in longitudinal direction of the web, i.e. in FIGS. 1 and 2 perpendicular to the drawing plane, and being defined as predetermined break lines for the package to be made, is reeled off from the roll in the packaging machine and two folds 2 and 3 are continuously formed with both flanks of each fold 2,3 sealed together over the entire fold width via the provided profile sealing layers. The folds 2,3 are applied in such a manner that both mentioned break lines g (extending perpendicular to the drawing plane in FIG. 1) extend at the inner fold flank (see FIG. 1). The folds 2,3 are then folded over onto the plane of the web 1 of packing material such that the fold flanks containing the break lines 4 do not lie on the surface of the package (see FIG. 2).

The packing material web 1 thus provided with both folds 2, 3 and moved in their longitudinal direction (i.e. in FIG. 2 perpendicular to the drawing plane) is then wrapped in conventional manner for formation of a tube around the successively fed pieces of goods such as e.g. chocolate bars 5 in direction of the arrows 6 whereupon the edge zones of the packing material web are connected with each other at the underside 7 of the chocolate bars 5 for providing a longitudinal sealing seam, and the fin created by this longitudinal sealing seam is then folded over onto the tube surface. The tube of packing material enclosing the chocolate bars 5 is then provided between two successive chocolate bars with two parallel transverse sealing seams and subdivided into single packages through parting cuts between these two transverse sealing seams.

FIG. 3 illustrates a perspective view on a somewhat enlarged scale of the thus made bag package. In FIG. 3, the longitudinal sealing seam 8 folded over onto the surface of the package and the fin 10 created by the transverse sealing seam 9 can be recognized. Arranged between the free edge 11 of this fin 10 and the strip-shaped sealing zone 12 of the transverse sealing seam g is a strip-shaped area 3 of a width from about 3 to 8 mm in which the tube of the packaging material is only pressed together. FIG. 3 shows further both 2,3 folded over onto the surface of the package with their outer fold edges flushing with both side edges 14,15 of the package. Both break lines 4 and the free edge 17 of the upper layer of the fin 10 in FIG. 4 which extends between the ends 16 of these break lines thus limit at three sides a tearing up zone 18 of the wrapper.

As can be seen from FIG. 3, the package is opened by holding with one hand the lowest layer of packing material of the fin 10 at 19 while the other hand grasps the free edge 17 of the upper layer which contains the tearing up zone 18 and pulls in the direction of arrow 20 thereby simultaneously tearing apart the packing material at the break lines 4 at both folds 2,3 and peeling off the edges of the tearing up zone 18 from the remaining parts of the folds 2,3.

FIG. 4 shows the package in an illustrating analogous to FIG. 3; however in half-opened state. The pulled off part of the tearing zone 18 and the peeled off strip-shaped area 21 of the seals provided for fixation of the folds 2,3 can be recognized.

in the previously described package, for example a three-layer packing material is used which—starting from the outside of the package—is made of a 0.012 to 0.015 mm thick foil of biaxially stretched polypropylene (OPP), an aluminum foil of 0.008 to 0.009 mm thickness and provided with a decorative printed inscription at the outside, a paper with a substance of 40 to 60 $g/m^2$ and a cold-bonding coating on latex base (e.g. about 3 $g/m^2$ solids) and preferably applied in profile. The break lines consist of several linear perforations spaced from each other and arranged successively along the break line progression. When equipping the packaging machine with a suitable device, these linear perforations can also be made during the production of the packing material web immediately before making the folds 2,3 in the packing material web.

A further advantageous embodiment of the package according to the invention will now be described with reference to FIGS. 5 to 8.

For making the package in the form of a tubular bag, a packing material web 22 which is unilaterally provided with a sealing layer applied in profile but in contrast to the package according to FIGS. 1 to 4 without break lines is initially reeled off from a roll in the packing machine, and in analogous manner as described with regard to FIGS. 1 and 2 two folds 23 and 24 are continuously formed (see FIG. 5). Thereafter, a strip-shaped area 25 of the fold 23 and 24, respectively, extending perpendicular to the drawing plane in FIG. 5 and illustrated in FIG. 5 by broken lines is continuously cut off at the fold edges so that the remaining material of the folds forms doubling areas 23' and 24' of the packing material. These doubling areas 23' and 24' are then folded over onto the plane of the packing material web 1 as illustrated in FIG. 6.

The packing material web 22 thus provided with doubling areas 23' and 24' is then used in analogous manner as described with respect to FIG 2 for making a tubular bag for chocolate bars 5.

FIG. 7 shows the thus made tubular bag in a perspective partial illustration. The longitudinal sealing seam 8' folded over onto the surface of the package and the fin 10' created by the transverse sealing seam 9' can be recognized. Like in the package according to FIG. 3, arranged between the free edge 11' of this fin 10' and the strip-shaped sealing zone 12' is a strip-shaped area 13 in which the tube of the packing material is merely pressed together. FIG. 7 further shows both doubling areas 23' and 24' folded over onto the surface of the package.

As can be seen from FIG. 7, the package is opened by holding with one hand the lower layer of packing material of the fin 10' at 19' while the other hand grasps the free edge 17' of the upper layer of packing material containing the tearing up zone 26 and pulls in direction o arrow 20 thereby peeling off the sealed connection of both doubling areas 23' and 24'. FIG. 8 shows this package in an illustration analogous to FIG. 7; however in half-opened state i.e. part of the tearing up zone is already pulled off.

In this package, for example a very simple packing material can be used which starting from the outside of the package—consists of a decorative printed inscription, a metallization, an OPP-foil of 0.02 to 0.04 mm thickness and a cold-bonding coating on Latex base (e.g. 3 g/m$^2$ solids).

According to further embodiments of the invention, the doubling areas 23', 24' folded over onto the surface of the package can be connected with the surface of the package by gluing or sealing.

in the first mentioned case, for example before the folding of the doubling areas 23', 24' onto the package material web 22, a hot-met adhesive is applied over dotted areas at predetermined gluing areas 27 (see FIG. 5), and then the doubling areas are folded over and pressed briefly to the packing material web 22 thereby attaining the gluing.

In the second case, strip-shaped coatings of hot-sealing lacquer e.g. on the basis of PVC/PVAc copolymer (size of coating 1 to 3 g/m$^2$) are applied already during production of the packing material at the outside of the packing material at the areas 27 and 28. After being folded over, the doubling areas 23', 24' are heat-sealed in the packaging machine with the packing material web 22.

COMMERCIAL EXPLOITATION

The essentially gastight and easy-to-open package in accordance with the invention can advantageously used, preferably in the form of tubular bags, for packing chocolate, waffles or other products in form of bars.

I claim:

1. Package for packing pieces of goods comprising a wrapper made of a flat foldable packing material having a first coplanar surface and an opposite second surface, said material folded to define at least two interconnected strip-shaped doubling areas (23', 24') of double layer thickness of said material, each doubling area formed by two strip-shaped areas of packing material bonded to each other on said first surface to form a strip-shaped sealing zone, each doubling area having an outer free edge which is folded over in opposite directions, relative to one another, onto said second surface, a tearing up zone (26) laterally defined by the packing material between said outer free edges of said doubling areas (23', 24') whereby the wrapper is opened by severing in the tearing up zone of at least one sealing zone of said doubling areas.

2. Package according to claim 1 characterized in that said doubling areas (23', 24') are arranged in the vicinity of opposite edges of the package.

3. Package according to claim 1 characterized in that the layers of packing material forming said doubling areas folded onto said second surface have contacting faces bonded together at least partially over the length of said package through gluing or heat sealing.

4. Package according to claim 1 characterized in that the wrapper is formed into a tubular bag with a longitudinal sealing seam (8') and two transverse seams (9') defining fins (10'), doubling areas (23', 24') laterally enclosing the tearing up zone (26) extend parallel to said longitudinal seam (8') and traverse a sealing zone (12') of at least one of the transverse sealing seams (9'), wherein the tearing up zone is longitudinally defined by at least one of said fins (10').

5. Package according to claim 4 characterized in that at least one of said fins (10') has a free edge (11'), in the tearing up zone, spaced from the sealing zone (12') of the transverse sealing seam (9') in the area at least between the ends of said doubling areas (23', 24').

6. A method of making the package according to claim 1 comprising the steps of;

forming two spaced folds in the packing material with parallel extending folding lines, sealing together the two strip-shaped areas of packing material which join the folding lines at both sides.

severing off a strip-shaped portion of the fold, along the longitudinal expanse of the fold, including the folding lines, with the remaining material of the fold thus defining said doubling areas of the wrapper, folding over the remainder of the strip-shaped portions of the packing material forming said doubling areas onto said second surface of the packing material situated outside the fold thus forming a prepared packing material for the package.

* * * * *